United States Patent [19]

Molnar

[11] 4,120,347

[45] Oct. 17, 1978

[54] TWO-PASSAGE PIPE, ESPECIALLY FOR AIR CONDITIONING INSTALLATIONS

[76] Inventor: Imre Molnar, Am Haushof 5, 4005 Meerbusch 1, Fed. Rep. of Germany

[21] Appl. No.: 729,147

[22] Filed: Oct. 4, 1976

[51] Int. Cl.[2] ..... F25B 29/00

[52] U.S. Cl. ..... 165/48 R; 98/38 R; 98/40 C; 138/116

[58] Field of Search ..... 165/22, 48; 98/40 C, 98/38 R, 38 B, 38 C, 38 D; 138/115, 116, 117

[56] References Cited

U.S. PATENT DOCUMENTS

| | | | |
|---|---|---|---|
| 2,164,394 | 7/1939 | Faber | 138/116 X |
| 3,615,253 | 10/1971 | Warzel | 23/285 X |
| 3,817,159 | 6/1974 | Bennett | 138/116 X |

*Primary Examiner*—Albert W. Davis, Jr.
*Attorney, Agent, or Firm*—Walter Becker

[57] ABSTRACT

A two-passage conductor, especially for conveying air in air conditioning installations, which includes a pipe having a flexible air impermeable diaphragm fastened to the pipe along diametrically oppositely located longitudinally extending sections of the pipe which are located substantially in the central longitudinal plane of the pipe, whereby the pipe is subdivided into two passages arranged alongside each other.

3 Claims, 3 Drawing Figures

TWO-PASSAGE PIPE, ESPECIALLY FOR AIR CONDITIONING INSTALLATIONS

The present invention relates to an air conditioning installation and to a pipe for constructing such air conditioning installation which pipe has two passages.

With a heretofore known construction of such pipe, the pipe is a rigid pipe which has arranged therein a flexible compressible tube so that the free flow cross sections of the rigid pipe and of the flexible compressible tube can be varied in conformity with the prevailing pressure conditions or quantity of air flow to be conveyed per time unit as a result of which there exists the possibility to convey air through the flexible inner tube only temporarily and to utilize the full cross section of the rigid outer tube by allowing the flexible inner tube to become pressure-less and to collapse.

The above described construction, however, can be used only for certain fields of employment. Thus, for instance, with an air conditioning installation the individual passages have to be provided with easily accessible cleaning openings in such a number and such a size that the passages can possibly be cleaned at any desired area. With the inner flexible tube, however, this requirement cannot be met because this inner tube can collapse when in pressure-less condition while in addition thereto the flexible tube is not easily accessible due to its position. In practice it is necessary when controlling or adjusting the installation, as is frequently the case, even in already working installations, to check such installations concerning pressure losses. Such checks may have to be made at places where no measuring stations have yet been provided. With the inner elastic tube also such checking operations cannot be carried out, and the provision of measuring stations and other devices, as for instance thermostats, hydrostats, etc., cannot or can only under great difficulties be realized with such flexible hose.

It is, therefore, an object of the present invention to provide a pipe with two passages by means of which through each of the two passage it is possible to convey different and varying quantities of air in conformity with the respective pressure conditions and other requirements.

It is another object of this invention to provide a pipe as set forth in the preceding paragraph, which will permit to vary the cross sections of the two passages in such a way that each of the two passages can convey up to 100% of the required quantity of the fluid while the respective other passage conveyes practically no fluid at all, and vice versa.

It is still another object of this invention to provide a pipe as set forth in the preceding two paragraphs, which will afford an easy access to the two passages, for instance, in order to allow a thorough cleaning of the individual passages or later to permit in the region of the two passages the provision of measuring stations to be able to carry out measuring and checking operations.

These and other objects and advantages of the invention will appear more clearly from the following specification in connection with the accompanying drawings, in which.

The two-passage pipe according to the invention is characterized primarily in that it is subdivided into two adjacent passages by means of a flexible air-impermeable diaphragm which is arranged primarily along the central plane of the pipe, the diaphragm being arranged between two pipe wall sections which are substantially located opposite to each other.

The pipe according to the present invention makes it possible to pass through each of the two passages a quantity of fluid which for all practical purposes corresponds to the total inner cross section of the pipe while in the respective other passage the quantity of fluid passing therethrough is practically zero, and vice versa. In this connection it is important that each of the two passages has a rigid outer wall so that the passages will be easily accessible, for instance for cleaning purposes and for the installation of measuring or checking stations, or the like.

Figure 1:
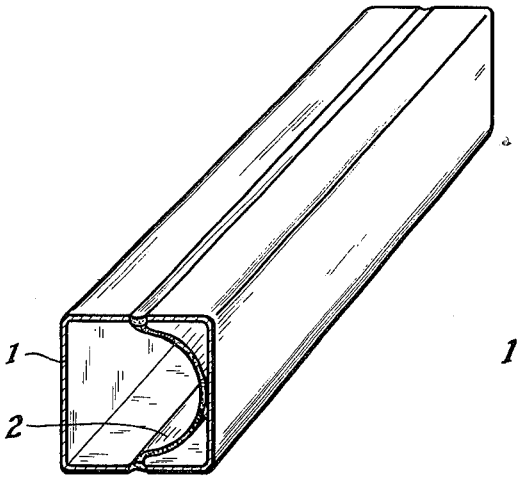
FIG. 1 represents an isometric view of the two-passage pipe according to the invention.
Figure 2:
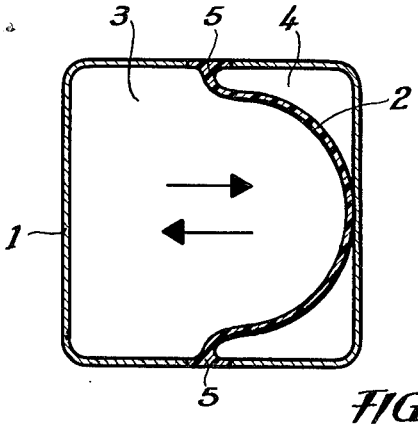
FIG. 2 represents a diagrammatic cross section of the pipe of FIG. 1.

Referring now to the drawings in detail, FIGS. 1 and 2 show a rigid outer pipe 1 which is subdivided into two passages 3 and 4 by means of a diaphragm 2 which is arranged in the central plane of the pipe 1. Pipe 1 consists primarily of two pipe sections between which the diaphragm 2 of sound-absorbing material is provided in the region of the connecting seams 5. According to the illustration of FIGS. 1 and 2, the diaphragm 2 occupies such a position that the main portion of the total flow cross section of pipe 1 is taken up by the passage 3 whereas only a small remaining cross section is left for the passage 4. The diaphragm 2 may, however, occupy any intermediate position so that each of the two passages in the extreme instant may occupy between zero and 100% of the total cross section of pipe 1.

Figure 3:
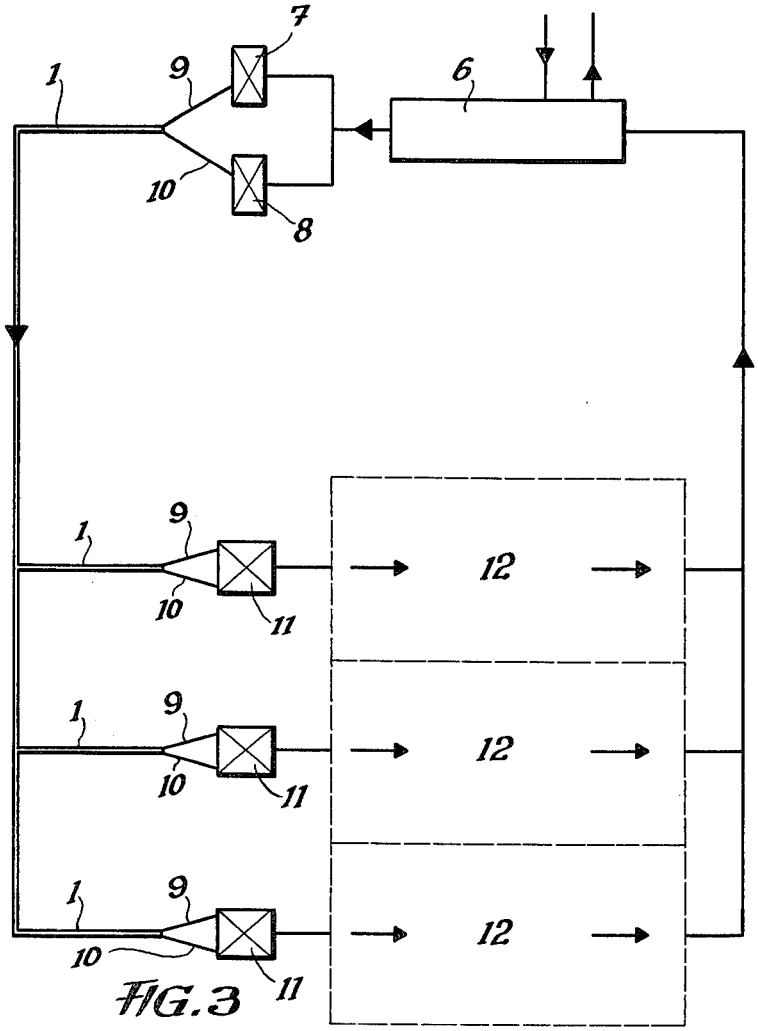
FIG. 3 shows the utilization of the pipe according to the invention in connection with a two-passage air conditioning installation.

In connection with the two-passage air conditioning installation shown in FIG. 3, it is to be noted that principally the meaning of a two-passage air conditioning installation consists in that supply air of two different temperatures, namely hot air and cold air, is passed through the two passages and that by intermixing these two air flows the respectively desired supply air-room entrance temperature is obtained which, as a rule, differs from room to room. The room entrance temperatures of the supply air, which may differ from room to room, are obtained by means of heretofore known mixing devices, which are controlled for instance by thermostats.

In view of the different distribution of the room loads (heat and cooling), while these differences may vary also within one and the same room, with all installed mixing devices of the air conditioning system, mixing conditions may result which differ from each other. Inasmuch as the quantity of air conveyed to the individual room or through the individual mixing device is constant, the temperature of the air flow leaving the mixing devices must be different. This means that although the installation is operated with a constant quantity of air, the ratios between hot and cold air are respectively different while these ratios also change continuously. Only in rare instances are these ratios between hot air and cold air 50:50.

Neither the hot air passage nor the cold air passage is with such two-passage air conditioning installation simultaneously used 100% because the components of cold air and hot air which are respectively required together amount always to 100% of the supply air. In view of peak loads, however, the cross section of the cold air passage must be designed for 100% and the cross section of the hot air passage must be designed for about 75% of the total supplied quantity of air. Such installations can be designed as low pressure as well as high pressure installations. As a rule, however, high pressure installations are preferred in order to obtain smaller cross sections of the passages.

The drawback of heretofore known installations of the general type involved consists in that in both passages large cross sections must be available so that the installation of correspondingly large dimensioned pipe lines in buildings is made more difficult and sometimes is even made impossible, while for the manufacture of such passages considerable work and material is required.

When employing the pipe according to the invention in connection with a two-passage air conditioning installation, a considerable reduction in the space requirement for the air conditioning conduits is obtained in a manner which is particularly simple in structural respect inasmuch as the cross section of the two passages is variable in such a way that each of the two passages can alternately convey from zero to 100% of the required quantity of supply air, for instance one of the passages can convey 75% and the other passage can convey 25% of the air.

With the two-passage air conditioning installation shown in FIG. 3, the air conditioning device 6 which leads into a supply passage has connected thereto, on the one hand, a post-heater 7 and, on the other hand, a cooler 8. From the post-heater 7 the heated supply air passes through the hot air conduit 9 into one passage, for instance passage 3, of the two-passage pipe 1 according to the invention, whereas the air leaving the cooler 8 passes through the cold air conduit 10 into the other passage, for instance passage 4, of the two-passage pipe 1. In the region of the individual consumer stations, for instance the rooms 12, to be cooled, two branch conduits branch off from the main pipe 1 while from the branch conduits the supply air flows pass through the hot air conduits 9 and cold air conduits 10 into the mixing devices 11 from which they are conveyed to the rooms 12. The air leaving the rooms 12 can subsequently through the air conditioning device be discharged into the atmosphere.

It is, of course, to be understood that the present invention is, by no means, limited to the specific showing in the drawings but also comprises any modifications within the scope of the appended claims.

1. Conveying means, especially for conveying air in air conditioning installations, which comprises in combination: a pipe, and a flexible air impermeable diaphragm fastened to said pipe along diametrically oppositely located sections of said pipe, said sections extending over the length of said pipe and being located substantially along a central longitudinal plane of said pipe thereby dividing said pipe into two adjoining passages arranged alongside each other, said diaphragm being in a position to vary flow quantity through said adjoining passages alternately between essentially 0% and 100% of the collective flow quantity possible through the two passages in said pipe.

2. Conveying means in combination according to claim 1, in which said diaphragm includes sound absorbing material.

3. In combination in an air conditioning installation: an air conditioning device having an air inlet and an air outlet, a plurality of rooms to be air conditioned having inlet means for admitting conditioned air and also having outlet means for discharging air to be re-conditioned, first conduit means establishing communication between said outlet means of said rooms and said inlet of said air conditioning device, second conduit means connected to said outlet of said air conditioning device and branching out into a first branch and a second branch, post-heater means having an air inlet communicating with said first branch and also having an outlet, cooler means having an inlet communicating with said second branch and also having an outlet, conveying means comprising a pipe and a flexible air impermeable diaphragm fastened to said pipe along diametrically oppositely located sections of said pipe, said sections extending over the length of said pipe and being located substantially along a central longitudinal plane of said pipe thereby dividing said pipe into two adjoining passages arranged alongside each other, said diagphragm being in a position to vary flow quantity through said adjoining passages alternately between essentially 0% and 100% of the collective flow quantity possible through the two passages in said pipe, said two passages respectively communicating with said outlet of said post-heater means and said cooler means for respectively conveying cooled and heated air to said inlet means of said rooms, and mixing means interposed between said conveying means and said rooms for respectively admixing cold and warm air to the air respectively passing through said two passages to said air in said passages prior reaching said rooms.

* * * * *